US006353389B1

(12) United States Patent
Matsuo

(10) Patent No.: US 6,353,389 B1
(45) Date of Patent: Mar. 5, 2002

(54) SHOPLIFT ALARMING DEVICE

(75) Inventor: Toichiro Matsuo, Arao (JP)

(73) Assignee: Matsuo Sangyo Kabushiki Kaisha, Fukoaka-ken (JP)

( * ) Notice: Subject to any disclaimer, the term of this patent is extended or adjusted under 35 U.S.C. 154(b) by 0 days.

(21) Appl. No.: 09/594,493

(22) Filed: Jun. 16, 2000

(51) Int. Cl.[7] ..... G08B 13/14

(52) U.S. Cl. ..... 340/571; 340/572.1; 340/572.8; 340/572.9; 340/568.1; 340/687

(58) Field of Search ..... 340/531, 572.1, 340/572.8, 572.9, 568.1, 568.2, 568.6, 686.1, 687, 686.4

(56) References Cited

U.S. PATENT DOCUMENTS

| | | | | | |
|---|---|---|---|---|---|
| 5,796,337 | A | * | 8/1998 | Wachsman | 340/568.8 |
| 6,177,869 | B1 | * | 1/2001 | McDaid | 340/568.1 |
| 6,188,320 | B1 | * | 2/2001 | Koiton et al. | 340/572.9 |
| 6,222,452 | B1 | * | 4/2001 | Ahistrom et al. | 340/572.1 |
| 6,255,947 | B1 | * | 7/2001 | Osawa et al. | 340/568 |

* cited by examiner

*Primary Examiner*—Daryl Pope

(74) *Attorney, Agent, or Firm*—Arent Fox Kintner Plotkin & Kahn PLLC

(57) ABSTRACT

A shoplift alarming device comprising: (1) one or more article-attachment portions each including a casing having an article-attachment surface, and a switch having a contact and a movable piece; (2) one or more cords each having a main lead line pair, i.e., first and second main lead lines connected to the switch, and a sub-lead line; (3) a cord connecting portion including terminal portions each having a pair of primary terminals for connection with the first and second main lead lines, a secondary terminal for connection with the sub-lead line, a pair of main terminals formed by a series connection of primary terminal pairs, and a sub-terminal connected to the respective secondary terminals; and (4) a monitoring portion having a main alarm, a first drive circuit driving the main alarm when a path between the main terminals is open, and a second drive circuit driving the main alarm when the main terminals are short-circuited, and when the sub-terminal and the main terminal are short-circuited; wherein the article-attachment portion is provided at the article-attachment surface with an electrode exposed at the article-attachment surface and connected to one of the first and second main lead lines (or the sub-lead line), and an electrically conductive adhesive film connected to the sub-lead line (or one of the first and second main lead lines), and disposed at a region of the article-attachment surface other than the electrode and the movable piece.

5 Claims, 3 Drawing Sheets

SHOPLIFT ALARMING DEVICE

BACKGROUND OF THE INVENTION

1. Field of the Invention

The present invention relates to a shoplift alarming device for preventing or suppressing shoplifting or pilferage of an item or article for sale.

2. Description of the Background Art

Various structures have been proposed for shoplift alarming devices which are used for preventing or suppressing pilferage of articles, e.g., displayed in a shop.

For example, a shoplift alarming device having an article-attachment portion to be attached to an article for sale has been proposed. This article-attachment portion has a switch having a contact, which opens and closes in accordance with a movable piece, as well as a casing accommodating the switch. This shoplift alarming device can issue an alarm in accordance with open-closed state of the contact of the switch.

The movable piece of above shoplift alarming device can move between the inside and the outside the casing, and is biased to project outward from the casing when it is not subjected to any force. The open-closed state of the contact of the switch relates to the position of the movable piece.

When the movable piece is pushed into the casing, the contact of the switch is in the closed state. When the movable piece is projected outward from the casing by the biasing force, the contact is open.

The article-attachment portion is attached to the article by a double-coated adhesive tape or the like so as that the movable piece is pushed into the casing for closing the contact of the switch.

When the article is pilfered or moved, and the article-attachment portion is removed from the article, the biased movable piece projects outward from the casing, and thereby the contact of the switch is opened, and thereby the alarm is issued, and therefore the pilferage of the article is prevented or suppressed.

However, the shoplift alarming device of the above type cannot issue the alarm, and therefore cannot prevent pilferage of the article, if the article-attachment portion is detached or removed from the article after the movable piece is held not to project outward from the casing by pushing or inserting a thin film, such as a knife blade or a resin plate, into a position between the article-attachment portion and the article, and thereby, after the contact of the switch is set not to become in the open state.

SUMMARY OF THE INVENTION

Accordingly, it is an object of the invention to provide a shoplift alarming device, in which a movable piece is biased, in a returnable fashion, to project outward from a casing, an article-attachment portion has a switch provided with a contact to be opened and closed in accordance with movement of the movable piece, the movable piece is pushed into the casing when the article-attachment portion is attached to the article, and an alarm is issued in accordance with the open-closed state of the contact of the switch. In particular, the object of the invention is to provide the shoplift alarming device, in which the alarm can be issued for preventing or suppressing pilferage of the article even when someone attempts to detach the article-attachment portion from the article after a thin film, such as a knife blade, a thin plate or the like, is inserted into a position between the article-attachment portion and the article to prevent the movable piece from projecting outward from the casing.

The invention provides a shoplift alarming device comprising:

(1) one or more article-attachment portions each including
- a casing having an article-attachment surface to be attached to an article, and
- a switch provided in the casing, and having a contact and a movable piece being returnably biased to project outward from the article-attachment surface of the casing, the contact being configured to be closed when the movable piece is pushed toward an inside of the casing and to be opened when the movable piece is projected outward from the article-attachment surface by the biasing force;

(2) one or more cords each having
- a main lead line pair formed of first and second main lead lines connected to respective terminals of the contact of the switch of the article-attachment portion, and
- a sub-lead line extending along the first and second main lead lines;

(3) a cord connecting portion including a plurality of terminal portions each having
- a pair of primary terminals for connection with ends, remote from the switch, of the first and second main lead lines of the cord,
- one secondary terminal for connection with an end, remote from the switch, of the sub-lead line,
- a pair of main terminals formed by a series connection of the plurality of primary terminal pairs, and
- one sub-terminal connected to the respective secondary terminals; and (4) a monitoring portion having
- a main alarm,
- a first main alarm drive circuit for activating the main alarm when a path between the main terminals of the cord connecting portion is electrically open, and
- a second main alarm drive circuit for activating the main alarm when the main terminals of the cord connecting portion are short-circuited, furthermore when the sub-terminal and the main terminal are short-circuited;

wherein the article-attachment portion is provided at the article-attachment surface of the casing with an electrode exposed at the article-attachment surface and electrically connected to one of the first and second main lead lines (or the sub-lead line), and an electrically conductive adhesive film electrically connected to the sub-lead line (or one of the first and second main lead lines), and disposed at a region of the article-attachment surface other than the electrode and the movable piece.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
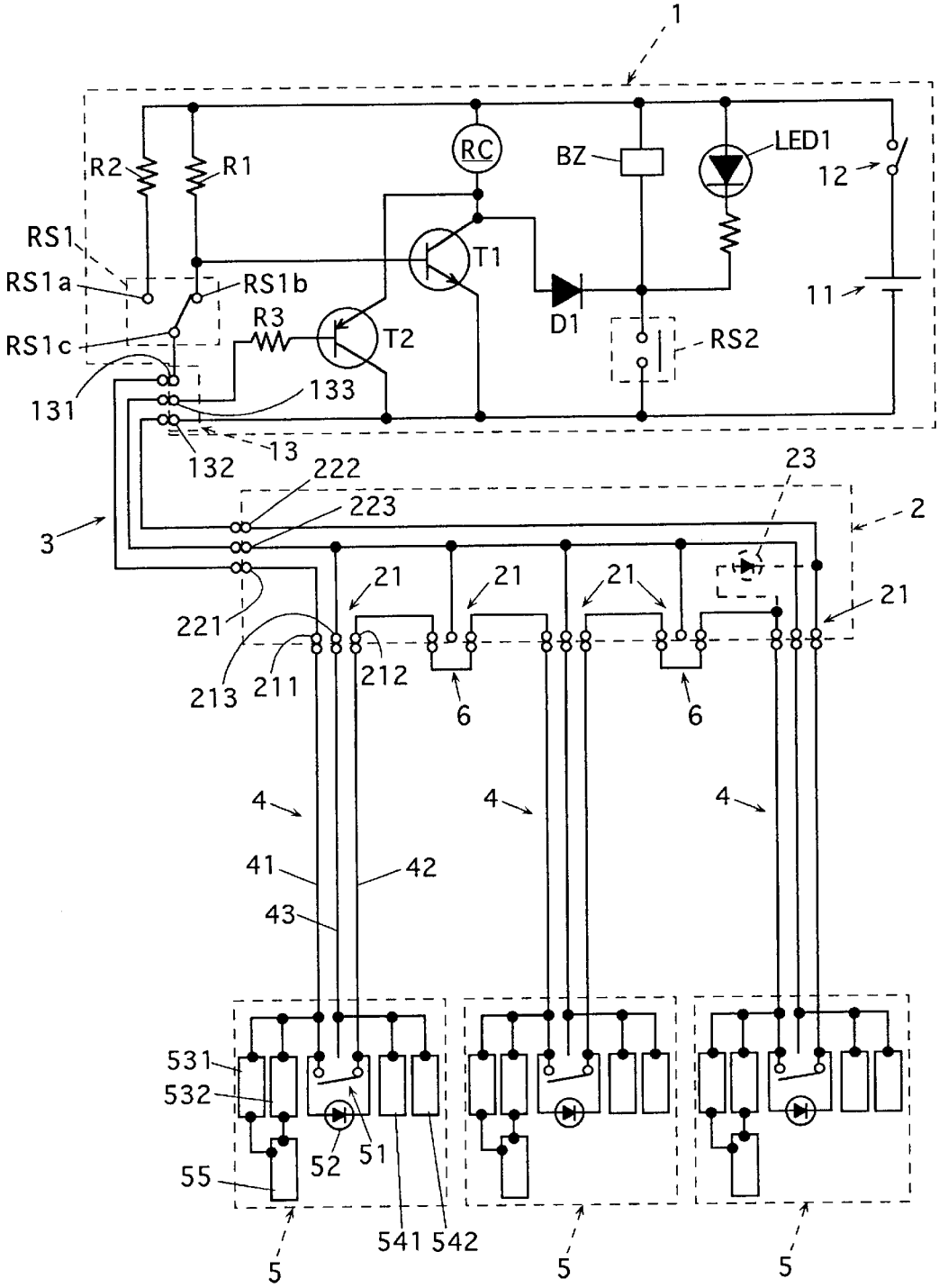
FIG. 1 shows a whole circuit diagram of an example of a shoplift alarming device according to the invention.

[1] The shoplift alarming device of the invention comprises:

(1) one or more article-attachment portions each including
- a casing having an article-attachment surface to be attached to an article, and
- a switch provided in the casing, and having a contact and a movable piece being returnably biased to project outward from the article-attachment surface of the casing, the contact being configured to be closed when the movable piece is pushed toward an inside of the casing and to be opened when the movable piece is projected outward from the article-attachment surface by the biasing force;

(2) one or more cords each having
- a main lead line pair formed of first and second main lead lines connected to respective terminals of the contact of the switch of the article-attachment portion, and
- a sub-lead line extending along the first and second main lead lines;

(3) a cord connecting portion including a plurality of terminal portions each having
- a pair of primary terminals for connection with ends, remote from the switch, of the first and second main lead lines of the cord,
- one secondary terminal for connection with an end, remote from the switch, of the sub-lead line,
- a pair of main terminals formed by a series connection of the plurality of primary terminal pairs, and
- one sub-terminal connected to the respective secondary terminals; and (4) a monitoring portion having
- a main alarm,
- a first main alarm drive circuit for activating the main alarm when a path between the main terminals of the cord connecting portion is electrically open, and
- a second main alarm drive circuit for activating the main alarm when the main terminals of the cord connecting portion are short-circuited, furthermore when the sub-terminal and the main terminal are short-circuited;

wherein the article-attachment portion is provided at the article-attachment surface of the casing with an electrode exposed at the article-attachment surface and electrically connected to one of the first and second main lead lines (or the sub-lead line), and an electrically conductive adhesive film electrically connected to the sub-lead line (or one of the first and second main lead lines), and disposed at a region of the article-attachment surface other than the electrode and the movable piece.

An article-attachment portion is to be attached to an article for sale. The article-attachment portion has a movable piece, a switch (alternatively, a switch provided with a movable piece) and a casing substantially covering them. One of the surfaces of the casing is to be attached to the article.

The movable piece is disposed such that the movable piece can move between the inside and the outside of the casing at the article-attachment surface of the casing (i.e., the surface of the casing to be attached to the article), e.g., through an aperture formed at the casing. The movable piece is biased to project outward from the casing. The movable piece may be configured to reciprocate linearly between the outside and the inside of the casing, or to swing around an axis so as to move between the outside and the inside of the casing.

The open-closed state of the contact of the switch relates to the position of the movable piece. When the movable piece is located inside of the casing, the contact of the switch is in the closed state. When the movable piece is not subjected to an external force, and is located in the projected position outside the casing by the biasing force, the contact of the switch is in the open state.

Thereby, the contact of the switch is closed when the article-attachment portion is attached to the article in such a manner that the movable piece is pushed into the casing. When the article-attachment portion thus attached is removed or detached from the article thereafter, the contact of the switch is normally opened.

An electrode and an electrically conductive adhesive film such as a conductive double-faced adhesive tape are arranged on the article-attachment surface of the casing. The casing can be attached to the article by this adhesive film. For example, if the conductive double-faced adhesive tape is employed, one of the surfaces of the double-faced adhesive tape is adhered to the article-attachment surface of the casing, and the other surface of the tape is adhered to the article so that the article-attachment portion is adhered to the article.

The electrode is electrically connected to one of first and second main lead lines of a cord, and the conductive adhesive film is connected to a sub-lead line of the cord. Alternatively, the electrode is electrically connected to a sub-lead line of a cord, and the conductive adhesive film is electrically connected to one of first and second main lead lines of the cord. Thus, the main lead line (the first or second main lead line) is electrically connected to one of the electrode and the conductive adhesive film, and the sub-lead line is electrically connected to the other.

Two or more electrodes may be employed. Two or more conductive adhesive films may be employed. The electrode may be electrically connected directly to the main lead line or the sub-lead line, or may be connected indirectly thereto via an electrically conductive member. The conductive adhesive film may be electrically connected directly to the main lead line or the sub-lead line, or may be indirectly connected thereto via an electrically conductive member (e.g., via an electrode other than the foregoing electrode).

The electrode and the movable piece are not covered with the conductive adhesive film, and are exposed at the article-attachment surface of the casing. The electrode and the conductive adhesive film are not electrically connected in a normal state.

The shoplift alarming device has one or more article-attachment portions described above.

The cord is connected to the article-attachment portion. The number of the cord(s) is equal to that of the article-attachment portion(s).

Each cord has three lead lines including a pair of main lead lines, i.e., the first and second main lead lines, and the sub-lead line extending along the main lead lines. The first main lead line has an end portion connected to one end of the contact of the switch. The second main lead line has an end portion connected to the other end of the contact of the switch. The cord may be formed of a multi-core or multi-line cable including, e.g., three or more cores. Alternatively, the cord may be formed of a shielded two-core cable, in which case the shield-line thereof may be used for one lead line (e.g., the sub-lead line) among the three lead lines.

The cord connecting portion has a plurality of terminal portions each for connection with the cord, a main terminal pair and a sub-terminal. The number of the terminal portions may be equal to or larger than the number of the cord(s) (=the number of the article-attachment portion(s)).

Each terminal portion has a primary terminal pair and a secondary terminal. When the cord is connected to the terminal portion, one of the primary terminals is connected to the end, remote from the switch, of the first main lead line, the other primary terminal is connected to the end, remote from the switch, of the second main lead line, and the secondary terminal is connected to the end, remote from the article-attachment portion, of the sub-lead line. For easy connection between the cord and the terminal portion in the above manner, a pair of male and female connectors may be employed.

In the cord connecting portion, the plurality of terminal portions are electrically connected to the main terminals and the sub-terminal in the following manner. The plurality of primary terminal pairs are connected in series, and the opposite ends of this series connection form the main terminals. Therefore, when all of the primary terminal pairs of the terminal portions are short-circuited, the main terminals are short-circuited. When a path between the primary terminal pairs of at least one of the terminal portions is electrically open, the path between the main terminals is open. The sub-terminal is connected to the respective secondary terminals.

The monitoring portion has a main alarm, a first main alarm drive circuit and a second main alarm drive circuit. The main alarm may be a lamp such as an LED (light-emitting diode), a buzzer or the like. Two or more main alarms may be employed. The first main alarm drive circuit drives the main alarm to issue the alarm or warning when the path between the main terminals of the cord connecting portion is electrically open. The second main alarm drive circuit drives the main alarm to issue the alarm when the main terminals of the cord connecting portion are short-circuited, and furthermore when the sub-terminal and the main terminal are short-circuited. In the case where a plurality of main alarms are employed, the main alarm(s) driven by the first main alarm drive circuit may be different from the main alarm(s) driven by the second main alarm drive circuit. The first and second main alarm drive circuits may have a common circuit portion used by both of the first and second main alarm drive circuits.

When using the shoplift alarming device according to the invention, each article-attachment portion is attached to the article by the adhesive film such as a double-faced adhesive tape. Thereby, each the movable piece, which was in the projected position outside the article-attachment surface of the article-attachment portion, is pushed into the casing so that each contact of the switch is closed. Each cord extending from the article-attachment portion is connected to one of the terminal portions of the cord connecting portion in the manner already described. In the terminal portion to which the cord, extending from the article-attachment portion having the switch in the closed state, is connected, the primary terminals thereof are short-circuited. In the case where the number of the terminal portions are larger than that of the cord(s) (i.e., the number of the article-attachment portion(s)), and thereby the shoplift alarming device has the terminal portion(s) to which the cord is not connected, the primary terminals of each terminal portion, to which the cord is not connected, are short-circuited by an appropriate short-circuit line. The state described above will be referred to as an "initial state" hereinafter.

In the initial state, the primary terminals in each terminal portion of the cord connecting portion are short-circuited. Further, the secondary terminal and the primary terminals in each terminal portion are not short-circuited. In the cord connecting portion, therefore, the main terminals are short-circuited, and the sub-terminal and the main terminals are not short-circuited. As a result, the first and second main alarm drive circuits do not drive the main alarm to issue the alarm.

After the shoplift alarming device is set to the initial state, if the article-attachment portion which was attached to the article is removed therefrom, the movable piece, which is biased toward the outside of the casing of the article-attachment portion, normally projects outward so that the contact of the switch of the article-attachment portion opens, and thereby the path between the main terminals of the cord connecting portion opens. Therefore, the first main alarm drive circuit drives the main alarm to issue the alarm.

After the shoplift alarming device is set to the initial state, if the cord is disconnected intentionally or accidentally from the terminal portion of the cord connecting portion, or if the first and/or second main lead lines of the cord are cut off intentionally or accidentally, the path between the main terminals of the cord connecting portion opens so that the first main alarm drive circuit drives the main alarm to issue the alarm.

A shoplifter may attempt to remove the article-attachment portion from the article for pilfering the article after achieving such a state that the main alarm is not driven by the first main alarm drive circuit even when the article-attachment portion is removed from the article. For this, the shoplifter may attempt to short-circuit between the first and second main lead lines of the cord extended from the article-attachment portion with a staple of a stapler or the like. In this operation of short-circuiting by the shoplifter, if the sub-lead line and at least one of the first and second main lead lines are short-circuited, the secondary terminal and the primary terminals of the terminal portion, to which above cord is connected, are short-circuited, and thereby the main terminals and the sub-terminal of the cord connecting portion are short-circuited so that the second main alarm drive circuit drives the main alarm to issue the alarm. In above state, since the switch in the article-attachment portion from which the above cord extends is in the closed state, the secondary terminal and both the primary terminals in the terminal portion, to which above cord is connected, are short-circuited, and therefore the sub-terminal and both the main terminals are short-circuited.

Also, a shoplifter may attempt to remove the article-attachment portion from the article for pilfering the article after achieving such a state that the main alarm is not driven by the first main alarm drive circuit even when the article-attachment portion is removed from the pilferage-target article. For achieving above state, the shoplifter may attempt to hold the movable piece of the article-attachment portion not to project outward by pushing or inserting a thin plate, such as a knife blade or a resin plate, into a position between the article and the article-attachment portion attached thereto with the conductive adhesive film therebetween. In this pushing or inserting process of the thin plate into the position between the article and the article-attachment portion (more strictly, between the article and the casing of the article-attachment portion), the conductive adhesive film is pushed while the conductive adhesive film is curled or crushed, and thereby the conductive adhesive film and the electrode come into contact with each other. Thereby, the sub-lead line is short-circuited to the first or second main lead line of the cord extending from above article-attachment portion, and therefore the secondary and primary terminals of the terminal portion, to which the above cord is connected, are short-circuited. Consequently, the sub-terminal of the cord connecting portion is short-circuited to the main terminal, and the second main alarm drive circuit drives the main alarm to issue the alarm. For reliably bringing the conductive adhesive film into contact with the electrode when the thin plate is pushed into the position between the article and the article-attachment portion, the movable piece may be disposed substantially in the center of the article-attachment surface of the article-attachment portion, the electrode may be disposed to substantially surround the movable piece, and the conductive adhesive film may be disposed to substantially surround the movable piece and the electrode.

After the state changes from the initial state to the state where the first or second main alarm drive circuit should drive the main alarm, and therefore the first or second main alarm drive circuit drives the main alarm, the first or second main alarm drive circuit may continue driving of the main alarm even when the state where the main alarm drive circuit should drive the main alarm is over. In this case, the main alarm drive circuit may be provided with a reset circuit for stopping driving of the main alarm.

The article-attachment portion may be further provided with an auxiliary alarm driven by applying a voltage thereto, and connected in parallel with the contact of the switch. For operating this auxiliary alarm, the monitoring portion may be provided with an auxiliary alarm drive circuit including a power source for applying a voltage across the main terminals of the cord connecting portion. The auxiliary alarm may be a lamp such as an LED lamp, a buzzer or the like. The auxiliary alarm in the article-attachment portion is to be attached to the article. In the initial state, since the switch, connected in parallel to the auxiliary alarm, is in the closed position, the opposite terminals of the auxiliary alarm are short-circuited, and therefore the voltage is not applied to the auxiliary alarm, and the auxiliary alarm does not issue the alarm. After the shoplift alarming device is set to the initial state, if the article-attachment portion is removed from the article, the movable piece thereof projects outward, and the switch of the article-attachment portion is opened, and thereby the voltage is applied to the auxiliary alarm from the power source of the auxiliary alarm drive circuit, and the auxiliary alarm issues the alarm.

The cord connecting portion may be further provided with an auxiliary alarm driven by applying a voltage thereto, and connected in parallel to the primary terminals of the terminal portion. For driving this auxiliary alarm, the monitoring portion may be provided with an auxiliary alarm drive circuit including a power source for applying the voltage across the main terminals of the cord connecting portion. Even in this case, the article-attachment portion may be also provided with the auxiliary alarm as already described. If both the cord connecting portion and the article-attachment portion are provided with the auxiliary alarms, respectively, the auxiliary alarm drive circuits for them may be a common circuit. When the cord is connected to the primary terminals to which the auxiliary alarm is connected in parallel, the auxiliary alarm is connected in parallel to the contact of the switch connected to the respective ends of the first and second main lead lines of above cord. In the initial state where the cord or the short-circuit line, for short-circuiting between the primary terminals of the terminal portion, is connected to the terminal portion to which the auxiliary alarm is connected, the opposite ends of the auxiliary alarm are short-circuited, and therefore the auxiliary alarm does not issue the alarm. In the case where the cord is connected to the terminal portion to which the auxiliary alarm is connected, a voltage is applied to the auxiliary alarm by the power source of the auxiliary alarm drive circuit to issue the alarm when the article-attachment portion, from which the cord is extended, is removed from the article and therefore the contact of the switch of the article-attachment portion opens, when the first and/or second main lead lines of the cord are cut off, or when the cord is removed from the terminal portion. In the case where the short-circuit line is connected to the terminal portion to which the auxiliary alarm is connected, the auxiliary alarm issues the alarm when the short-circuit line is cut off, or when the short-circuit line is disconnected from the terminal portion.

[2] Embodiments of the invention will now be described with reference to the drawings.

FIG. 1 is a circuit diagram of an example of a shoplift alarming device according to the invention.

This shoplift alarming device is provided with article-attachment portions 5 to be attached to articles, respectively, and a monitoring portion 1 having alarms and a drive circuit of the alarms for issuing an alarm or warning when pilferage or attempt of pilferage of the article for sale is detected by the article-attachment portion 5 and others. The shoplift alarming device in this embodiment has three article-attachment portions 5. From each of the article-attachment portions 5, a cord 4 is extended. Each article-attachment portion 5 is connected to the monitoring portion 1 via the cord 4, a cord connecting portion 2 for connecting a plurality of (five in this example) cords 4 thereto and a coupling cord 3 for coupling the cord connecting portion 2 to the monitoring portion 1.

Figure 2A:
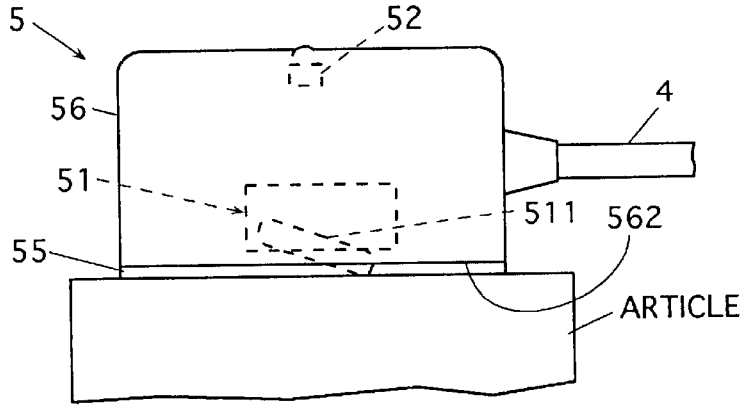
FIG. 2(A) is a schematic side view showing the shoplift alarming device according to the invention, and particularly showing an article-attachment portion thereof attached to an article.
Figure 2B:
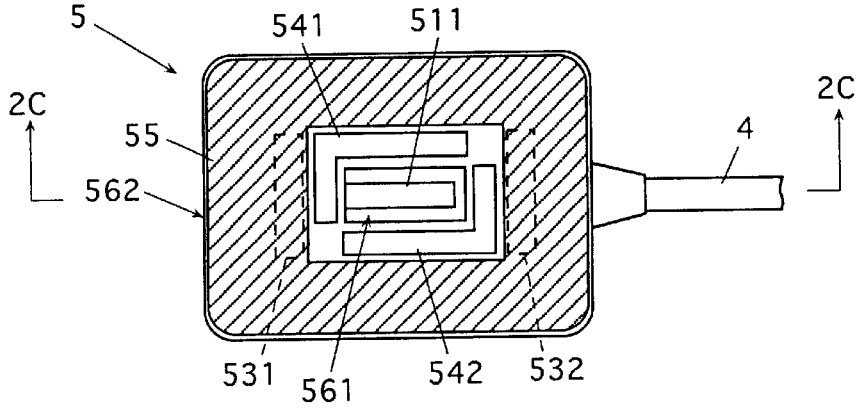
FIG. 2(B) is a schematic bottom view of the article-attachment portion viewed from the article side.
Figure 2C:
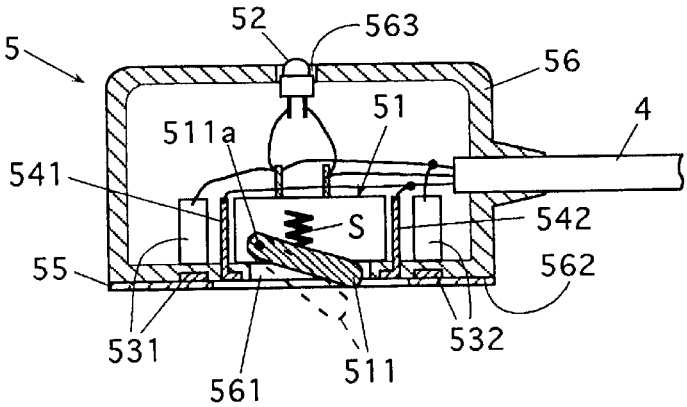
FIG. 2(C) is a schematic cross section of the article-attachment port on taken along line 2C—2C in FIG. 2(B)

FIG. 2(A) is a schematic side view of the article-attachment portion 5. FIG. 2(B) is a schematic bottom view of the article-attachment portion 5 viewed from an article-attachment surface. FIG. 2(C) is a schematic cross section of the article-attachment portion 5 taken along line 2C—2C in FIG. 2(B).

The article-attachment portion 5 has a switch 51 having a movable lever 511, which is an example of the movable piece, as well as a light-emitting diode (LED) lamp 52 serving as an auxiliary alarm and a casing 56 accommodating these parts.

The movable lever 511 of the switch 51 can swing around an axis 511*a*. The switch 51 is disposed within the casing 56 in such a manner that the movable lever 511 can move between the outside and the inside of the casing 56 through an aperture 561 formed at an article-attachment surface 562, to be attached to the article, of the casing 56. The movable lever 511 is biased by a spring S toward the outside of the casing 56. The position of the movable lever 511 relates to the open-closed state of the contact of the switch 51. When the movable lever 511 is in the depressed position inside the casing 56, the contact of the switch 51 is closed. When the movable lever 511 is in the projected position outside the casing 56, the contact of the switch 51 is open.

The lamp 52 is disposed within the casing 56, and a light emitting portion thereof is externally exposed through an aperture 563 formed in the casing 56. The lamp 52 is electrically connected in parallel to the opposite ends of the contact of the switch 51.

The cord 4 extends from each article-attachment portion 5. The cord 4 has three lead lines. More specifically, the cord 4 has a pair of main lead lines 41 and 42 (i.e., the first and second main lead lines) and one sub-lead line 43. The sub-lead line extends along the main lead lines 41 and 42, and has a substantially same length as them.

An end of the first main lead line 41 is connected to one end of the contact of the switch 51 at the inside of the casing 56. An end of the second main lead line 42 is connected to the other end of the contact of the switch 51 at the inside of the casing 56.

There are arranged four electrodes 531, 532, 541 and 542 at the article-attachment surface 562, to be attached to the article, of the casing 56 of the article-attachment portion 5. These electrodes are fitted into the grooves and apertures formed at the casing surface 562, respectively.

Each of the electrodes 541 and 542 has an L-shaped form. The electrodes 541 and 542 are disposed at the surface 562, and substantially surrounds the aperture 561 for allowing movement of the movable lever 511 between the outside and the inside of the casing 56. Each of the electrodes 541 and 542 has a portion, which is projected into the casing 56 and, in this example, is electrically connected to the sub-lead line 43.

The electrodes 531 and 532 are disposed outside the electrodes 541 and 542 at the casing surface 562, respectively. Each of the electrodes 531 and 532 has a portion which is projected into the casing 56 and, in this example, is electrically connected to the main lead line 41. The electrodes 531 and 532 may be electrically connected to the main lead line 42 instead of the main lead line 41.

An electrically conductive double-faced tape 55 is fixed to the casing surface 562 in such a manner that the tape 55 substantially surrounds the aperture 561 and the electrodes 541 and 542 at the casing surface 562. Thus, the electrodes 541 and 542 are not covered with the tape 55, and are exposed. The electrodes 531 and 532 are in contact with the tape 55, and therefore are electrically connected to the tape 55. Thus, the tape 55 is electrically connected to the main lead line 41 via the electrodes 531 and 532.

The cord connecting portion 2 has a plurality of terminal portions 21 (five terminal portions in this example) each to which the cord 4 can be connected. The cord connecting portion 2 further has a pair of main terminals 221 and 222, and a sub-terminal 223.

Each terminal portion 21 has three terminals, i.e., a pair of primary terminals 211 and 212 as well as one secondary terminal 213. When the cord 4 is connected to the terminal portion 21, the main terminal 211 is connected to the end, remote from the switch 51, of the first main lead line 41. The other main terminal 212 is connected to the end, remote from the switch 51, of the second main lead line 42. The secondary terminal 213 is connected to the end, remote from the article-attachment portion 5, of the sub-lead line 43. For easy connection of the cord 4 to the terminal portion 21, a male connector (not shown) is provided at the end of the cord 4 to be connected to the terminal portion 21, and a female connector (not shown) which can be fitted with the male connector is provided at the terminal portion 21. By fitting the male connector of the cord 4 to the female connector of the terminal portion 21, the cord 4 can be connected to the terminal portion 21 as described above.

The five terminal portions 21 of the cord connecting portion 2 are electrically connected to the main terminals 221 and 222 as well as the sub-terminal 223 in the following manner. The primary terminals 211 and 212 of each terminal portion 21 are connected in series, and the opposite ends of the series connection are connected to the main terminals 221 and 222, respectively. Accordingly, when the paired primary terminals 211 and 212 are short-circuited in all the terminal portions 21, the main terminals 221 and 222 are short-circuited. When the path between the primary terminals 211 and 212 of at least one of the terminal portions 21 is electrically open, the path between the main terminals 221 and 222 is open. The sub-terminal 223 is electrically connected to the secondary terminal 213 in each terminal portion 21.

In this embodiment, the cord connecting portion 2 and the monitoring portion 1 are connected together via the coupling cord 3 in the following manner. The monitoring portion 1 has a terminal portion 13 formed of three terminals 131, 132 and 133 for connection to the cord connecting portion 2. The coupling cord 3 couples the main terminals 221 and 221 to the terminals 131 and 132, respectively, and also connect the sub-terminal 223 to the terminal 133.

The monitoring portion 1 has a buzzer BZ and a light-emitting diode (LED) lamp LED1 both serving as the main alarms, and a drive circuit for these main alarms. The monitoring portion further has a drive circuit of the lamp 52 serving as the auxiliary alarm and disposed at the article-attachment portion 5.

The buzzer BZ and the lamp LED1 are parallel connected to each other. The buzzer BZ and the lamp LED1 thus parallel connected have an end connected to the positive side of a power source 11 via a main switch 12, and have the other end connected to the negative side of the power source 11 via a normal-open contact RS2 of a relay. In this embodiment, the power source 11 is a battery, but may be another power source, if necessary. The relay contact RS2 is closed when a relay coil RC is energized.

One end of the relay coil RC is connected to the positive side of the power source 11 via the main switch 12. The other end of the relay coil RC is connected to the negative side of the power source 11 via collector and emitter terminals of a transistor T1, and is also connected to the negative side of the power source 11 via a diode D1 and the relay contact RS2, and is also connected to the negative side of the power source 11 via a emitter and collector terminals of a transistor T2. In the state where the main switch 12 is in the closed position, the relay coil RC is energized when the transistor T1 is on, the transistor T2 is on or the relay contact RS2 is closed.

The base terminal of the transistor T1 is connected to the positive side of the power source 11 via a resistance R1 and the main switch 12, and is also connected to the negative side of the power source 11 via a relay contact RS1 and the terminal portion 13 connected to the cord connecting portion 2.

The relay contact RS1 has three terminals RS1*c*, RS1*a* and RS1*b*. The terminal RS1*c* serves as a common terminal. The terminals RS1*c* and RS1*a* form a normal-open contact. The terminals RS1*c* and RS1*b* form a normal-close contact. In the relay contact RS1, the normal close contact is closed when the relay coil RC is not energized. The normal open contact is closed when the coil RC is energized.

The common terminal RS1*c* of the relay contact RS1 is connected to the terminal 131 of the terminal portion 13. The terminal RS1*b* is connected to the base terminal of the transistor T1. The transistor T1 is on when the main switch 12 is closed and the path between the terminals 131 and 132 of the terminal portion 13 is open, thus the path between the main terminals 221 and 222 of the cord connecting portion 2 is open.

The terminal RS1*a* of the relay contact RS1 is connected to the power source 11 via a resistance R2 and the main switch 12. The power source 11 can apply a voltage across the main terminals 221 and 222 of the cord connecting portion 2 via a resistance R2 when the normal-open contact (between terminals RS1*a* and RS1*c*) of the relay contact RS1 is closed.

The base terminal of the transistor T2 is connected to the terminal 133 of the terminal portion 13 via the resistance R3. The transistor T2 is on when the main switch 12 is closed, the path between the main terminals 221 and 222 of the cord connecting portion 2 is closed and the sub-terminal 223 of the cord connecting portion 2 is short-circuited to the main terminals 221 and/or 222.

When using the shoplift alarming device of the invention described above, each article-attachment portion 5 is attached to the article by the double-faced adhesive tape 55 adhered to the casing surface 562 as shown in FIG. 2(A). Thereby, the movable lever 511, which was in the position projected from the article-attachment surface 562 of each article-attachment portion 5, is pushed into the casing 56, and the contact of the switch 51 is closed. The cord 4 extended from each article-attachment portion 5 is connected to one of the terminal portions 21 of the cord connecting portion 2 in the foregoing manner. Thereby, the primary terminals 211 and 212 of the terminal portion 21, to which the cord 4 is connected, of the cord connecting portion 2 are short-circuited. A short-circuit line 6 is connected to each terminal portion 21 to which the cord 4 is not connected for short-circuiting the primary terminals 211 and 212 thereof. Finally, the main switch 12 is closed. In the following description, the state described above will be referred to as an "initial state".

In the initial state, the primary terminals 211 and 212 are short-circuited in all the terminal portions 21 of the cord connecting portion 2. In all the terminal portions 21, secondary terminal 213 is not short-circuited to the primary terminals 211 and 212. Accordingly, the main terminals 221 and 222 in the cord connecting portion 2 are short-circuited, and the sub-terminal 213 is not short-circuited to the main terminals 221 and 222. As a result, neither of the transistors T1 and T2 of the monitoring portion 1 is on so that the relay coil RC is not energized, and the relay contact RS2 is open. Therefore, the buzzer BZ and the lamp LED1 serving as the main alarms do not operate to issue the alarm. Further, the lamp 52 serving as the auxiliary alarm of each article-attachment portion 5 is not supplied with a voltage, and therefore does not issue the alarm because the contact of the switch 51 which is in parallel with the lamp 52 is closed.

A shoplifter may pilfer or attempt to pilfer the article. Also, a customer may lift or move the article with the hand for observation or the like. In these case, the article-attachment portion 5 may be removed incidentally or intentionally from the article. When the article-attachment portion, which was in the initial state, is removed, the movable lever 511 biased toward the outside of the casing 56 normally projects from the casing 56 so that the contact of the switch 51 of this article-attachment portion 5 opens, and the path between the main terminals 221 and 222 of the cord connecting portion 2 opens. Thereby, the transistor T1 is turned on to energize the relay coil RC so that the relay contact RS2 is closed to apply the voltage to the buzzer BZ and the lamp LED1 serving as the main alarms, and these main alarms issue the alarm. When the relay coil RC is once energized, the energized state of the relay coil RC is held by the self-contact RS2 connected in series to the power source 11. Therefore, even when the transistor T1 is turned off thereafter, the buzzer BZ and the lamp LED1 continue the operation of issuing the alarm. This alarm continues until the main switch is turned off. When the transistor T2 is turned on as described later, a similar self-holding state is attained. When the relay coil RC is energized, the normal-open contact between the terminals RS1*a* and RS1*c* in the relay contact RS1 is closed to apply the voltage from the power source 11 via the resistance R2 across the main terminals 221 and 222 of the cord connecting portion 2. Therefore, the voltage is applied to the lamp 52 of the article-attachment portion 5 in which the contact of the switch 51 is open so that the lamp 52 is turned on to issue the alarm. The resistance R2 has a resistance value which is determined to flow a current of an appropriate magnitude to the LED lamp 52.

According to the shoplift alarming device of the invention, when the article-attachment portion 5 attached to the article is removed incidentally or intentionally from the article, the buzzer BZ and the lamp LED1 serving as the main alarms provided in the monitoring portion 1 normally issue the alarm as described above, and the lamp 52 which is the auxiliary alarming device at the article-attachment portion 5 likewise issues the alarm. Thereby, a salesperson or a guard, who is informed that the article becomes to be in the abnormal state by the main alarm of the monitoring portion 1, can hurry to the place where the article is displayed. The salespersons and/or the guards, who hurried as described above or were present near the article, can rapidly identify the article in the abnormal state owing to the auxiliary alarm issued as described above.

It is also possible to give to the person, who is attempting to shoplift the article, the warning that the act of stealing is become known. Since the lamp 52 serving as the auxiliary alarm is attached to the article, it is located just beside the article, and can issue the alarm at the position on or extremely near the hand of the shoplifter. Accordingly, the alarm thus issued can effectively act to suppress the pilferage, and the pilferage can be effectively prevented or suppressed as compared with the case where an alarm is issued at a position remote from the article.

After one of the article-attachment portions 5 was removed incidentally or intentionally from the article, if another article-attachment portion 5 (i.e., second article-attachment portion 5) is removed from the corresponding article (i.e., second article) by the shoplifter, the contact of the switch 51 of the second article-attachment portion 5 attached to the second article becomes open state. In this case, the lamp 52 which is the auxiliary alarm at the second article-attachment portion 5 for the second article also issues the alarm. This can prevent or suppress another pilferage which is being attempted in the following manner. When the alarm is first issued, the article corresponding to the article-attachment portion issuing the alarm attracts the attention of the salesperson, guard and/or customer. During this, the shoplifter may attempt to pilfer the second article by removing the second article-attachment portion 5 therefrom. However, the alarm is issued from the auxiliary alarm at the vicinity of the shoplifter who is attempting to pilfer the second article. Thereby, shoplifting of the two or more articles can be effectively prevented or suppressed. If the alarm is located only in a position remote from the article, a problem may occur when two or more articles are being pilfered as described above. More specifically, the alarm which is issued due to the pilferage of the second article may hardly attract the attention when the second article is being pilfered while the first alarm issued due to the pilferage is attracting the attention, although the first alarm can prevent the pilferage of the first article.

In this example, the LED lamp 52 is employed as the auxiliary alarm provided at the article-attachment portion 5. However, a buzzer or the others may be employed as the auxiliary alarm. The sound alarm of the buzzer can attract the attention more effectively than the light alarm of the lamp.

The shoplift alarming device according to the invention can issue the alarm even in the following cases.

After the shoplift alarming device is set to the initial state, if the cord 4 is removed from the terminal portion 21 of the cord connecting portion 2 incidentally or intentionally, or when the first and/or second main lead lines 41 and/or 42 of the cord 4 are cut off incidentally or intentionally, the path between the main terminals 221 and 222 of the cord connecting portion 2 opens similarly to the foregoing case so that the transistor T1 is turned on, and the main alarms, i.e., the buzzer BZ and the lamp LED1 issue the alarm. In this case, the lamp 52 provided at the article-attachment portion 5 does not issue the alarm. For rapidly identifying which cord 4 is in abnormal state even in this case, and for issuing the alarm in the position as near to the article as possible, an auxiliary alarm (second auxiliary alarm) may be arranged in the following position of the cord connecting portion 2. More specifically, as indicated by broken line in FIG. 1, an auxiliary alarm (LED lamp 23 in this example) which operates by applying a voltage thereto may be arranged in parallel with the primary terminals 211 and 212 of the terminal portion 21. The second auxiliary alarm may be a 20 buzzer or the others instead of the lamp 23.

When the cord 4 is incidentally or intensionally removed from the terminal portion 21 provided with the lamp 23, when the first and/or second main lead lines 41 and/or 42 of the cord 4, connected to the terminal portion 21 provided with the lamp 23, are incidentally or intensionally cut off, or when the contact of the switch 51 of the article-attachment portion 5 from which the cord 4, connected to the terminal portion 21 provided with the lamp 23, extends is opened, the transistor T1 is turned on to close the normal-open contact of the relay contact RS1, and the power source 11 applies the voltage via the resistance R2 to the lamp 23 so that the lamp 23 is turned on to issue the alarm. In this example, the lamp 23 in the cord connecting portion 2 is driven by the drive circuit including the power source 11 which is commonly used for the lamp 52 in the article-attachment portion 5. Provision of the auxiliary alarm in the cord connecting portion 2 can prevent the pilferage further effectively.

A shoplifter may attempt to pilfer the article by removing the article-attachment portion 5 from the article after achieving such a state that the removable of the article-attachment portion 5 from the article does not open the path between the primary terminals 211 and 212 of the terminal portion 21 of the cord connecting portion 2 to which the cord 4, extending from the article-attachment portion 5 attached to the pilferage-target article, is connected. In other words, the shoplifter may attempt to pilfer the article by removing the article-attachment portion 5 from the article after achieving such a state that the path between the main terminals 221 and 222 does not open, and the transistor T1 is not turned on, and thereby main alarm in the monitoring portion 1 does not issued the alarm even when the article-attachment portion 5 is removed from the pilferage-target article. For achieving the above state, the shoplifter may attempt to short-circuit the first and second main lead lines 41 and 42 of the cord 4 with a staple of a stapler or the like. In this operation of short-circuiting by the shoplifter, if the sub-lead line 43 of the cord 4 is short-circuited to at least one of the first and second main lead lines 41 and 42, the secondary terminal 213 of the terminal portion 21, to which above cord 4 is connected, is short-circuited to the primary terminals 211 and 212, and thereby the main terminals 221 and 222 of the cord connecting portion 2 are short-circuited to the sub-terminal 223, and therefore the transistor T2 is turned on, and resulting in that the main alarms, i.e., the buzzer BZ and the lamp LED1 of the monitoring portion 1 issue the alarm. Accordingly, pilferage of the article can be prevented or suppressed even in the above case.

Figure 3:
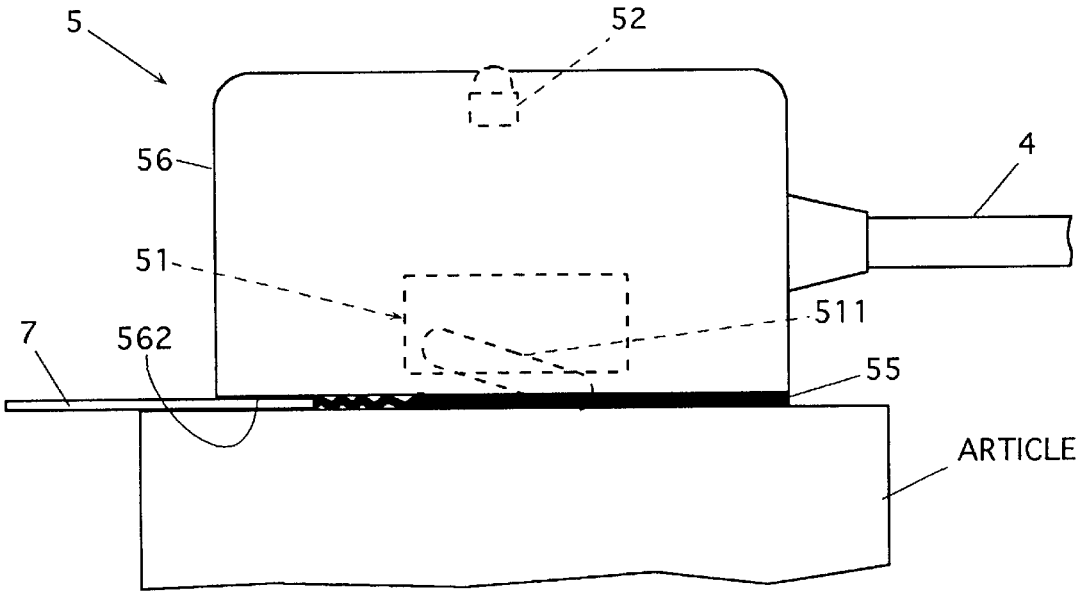
FIG. 3 shows a state where a thin plate is pushed into a position between the article-attachment portion and the article.

When the article-attachment portion 5 in the initial state is removed from the article, the movable lever 511 of the article-attachment portion 5 normally projects outward from the casing 56 as already described, and thereby the contact of the switch 51 of the article-attachment portion 5 opens so that the alarm is issued. However, the shoplifter may attempt to remove the article-attachment portion 5 from the article for pilfering the article after attaining such a state that the movable lever 511 can not project outward from the casing 56, and thereby the switch 51 does not open, and therefore the alarm is not issued. For this, the shoplifter may push or insert a thin plate such as a knife blade or a resin plate into a position between the article and the article-attachment portion 5. In this case, the alarm is issued in the following manner. As shown in FIG. 3, when a thin plate 7 is pushed into a position between the article and the article-attachment portion 5 (more strictly, between the article and the casing surface 562 of the article-attachment portion 5) for holding the movable lever 511 of the article-attachment portion 5 by the thin plate 7 to prevent projection thereof from the casing 56, the adhesive tape 55 located between the article and the casing surface 562 is pushed toward the movable lever 511 by the thin plate 7 while the tape 55 is curled or crushed. Accordingly, the adhesive tape 55 comes into contact with the electrodes 541 and/or 542 disposed around the lever 511 before the thin plate 7 holds the movable lever 511 to prevent projection thereof from the casing 56.

When the tape 55 comes into contact with the electrode 541 or 542, the sub-lead line 43 of the cord 4 extending from the article-attachment portion 5 is short-circuited to the first and second main lead lines 41 and 42, and thereby the main terminals 221 and 222 of the cord connecting portion 2 are likewise short-circuited to the sub-terminal 223 so that the transistor T2 is turned on, and the buzzer BZ and the lamp LED1 issue the alarm.

At the article-attachment surface 562 of the article-attachment portion 5, the movable lever 511 is disposed substantially in the central position of the surface 562, and the electrodes 541 and 542 substantially surround the movable lever 511, and further, the conductive adhesive tape 55 substantially surrounds the movable lever 511 and the electrodes 541 and 542. Therefore, when the thin plate 7 is pushed to move the tape 55 toward the movable lever 511, it is possible to bring the tape 55 into contact with the electrodes 541 or 542 with reliability. Thereby, pilferage of the articles can be effectively prevented, and the attempt to pilfer can be effectively suppressed.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A shoplift alarming device comprising:

a) one or more article-attachment portions each including a casing having an article-attachment surface to be attached to an article, and a switch provided in said casing, and having a contact and a movable piece being returnably biased to project outward from said article-attachment surface of said casing, said contact being configured to be closed when said movable piece is pushed toward an inside of said casing and to be opened when said movable piece is projected outward from said article-attachment surface by the biasing force;

b) one or more cords each having a main lead line pair formed of first and second main lead lines connected to respective terminals of said contact of said switch of said article-attachment portion, and a sub-lead line extending along said first and second main lead lines;

c) a cord connecting portion including a plurality of terminal portions each having a pair of primary terminals for connection with ends, remote from said switch, of said first and second main lead lines of said cord, one secondary terminal for connection with an end, remote from said switch, of said sub-lead line, a pair of main terminals formed by a series connection of said plurality of primary terminal pairs, and one sub-terminal connected to said respective secondary terminals; and d) a monitoring portion having a main alarm, a first main alarm drive circuit for activating said main alarm when a path between said main terminals of said cord connecting portion is electrically open, and a second main alarm drive circuit for activating said main alarm when said main terminals of said cord connecting portion are short-circuited, furthermore when said sub-terminal and said main terminal are short-circuited;

wherein said article-attachment portion is provided at said article-attachment surface of said casing with an electrode exposed at said article-attachment surface and electrically connected to one of said first and second main lead lines, or said sub-lead line, and an electrically conductive adhesive film electrically connected to said sub-lead line, or one of said first and second main lead lines, and disposed at a region of said article-attachment surface other than said electrode and said movable piece.

2. The shoplift alarming device according to claim 1, wherein said conductive adhesive film is a conductive double-faced adhesive tape.

3. The shoplift alarming device according to claim 1, wherein at said article-attachment surface of said casing of said article-attachment portion, said movable piece is disposed substantially in the center of said article-attachment surface, said electrode substantially surrounds said movable piece, and said adhesive film substantially surrounds said movable piece and said electrode.

4. The shoplift alarming device according to claim 1, wherein at least one of said article-attachment portions further includes an auxiliary alarm driven by applying a voltage thereto, and connected in parallel to the contact of said switch, and said monitoring portion further includes an auxiliary alarm drive circuit including a power source for applying a voltage across said main terminals.

5. The shoplift alarming device according to claim 1, wherein said cord connecting portion further includes at least one auxiliary alarm driven by applying a voltage thereto, and connected in parallel to the primary terminals of said terminal portion, and said monitoring portion further includes an auxiliary alarm drive circuit including a power source for applying a voltage across said main terminals.

* * * * *